US006185747B1

(12) United States Patent
Hughes

(10) Patent No.: US 6,185,747 B1
(45) Date of Patent: Feb. 13, 2001

(54) FABRIC GLOVE WITH WEAR RESISTANT PADS SEPARATED BY FLEXIBILITY ZONES AND METHOD OF MAKING THE SAME

(75) Inventor: Griffith W. Hughes, Wayne, PA (US)

(73) Assignee: Commodity Glove Company, Inc., Wayne, PA (US)

( * ) Notice: Under 35 U.S.C. 154(b), the term of this patent shall be extended for 0 days.

(21) Appl. No.: 09/441,127

(22) Filed: Nov. 17, 1999

(51) Int. Cl.[7] ..... A41D 19/00
(52) U.S. Cl. ..... 2/161.6
(58) Field of Search ..... 2/16, 20, 21, 159, 2/160, 161.1, 161.2, 161.3, 161.6, 161.7, 163, 167

(56) References Cited

U.S. PATENT DOCUMENTS 3,597,765 * 8/1971 Stanton .
4,042,975 * 8/1977 Elliott, Jr. et al. .
4,526,828 * 7/1985 Fogt et al. ..... 428/229
4,663,784 * 5/1987 Ash .
4,691,387 * 9/1987 Lopez .
4,748,690 * 6/1988 Webster .
5,218,719 * 6/1993 Johnson .
5,231,700 * 8/1993 Cutshall ..... 2/161.7
5,581,809 * 12/1996 Mah .
5,987,646 * 11/1999 Bolmer ..... 2/161.1
6,016,571 * 1/2000 Guzman et al. ..... 2/167
6,035,444 * 3/2000 McGrew ..... 2/161.1
6,044,493 * 4/2000 Post ..... 2/167
6,087,279 * 7/2000 Laun ..... 442/402

* cited by examiner

*Primary Examiner*—John J. Calvert
*Assistant Examiner*—Katherine Moran
(74) *Attorney, Agent, or Firm*—Caesar, Rivise, Bernstein, Cohen & Pokotilow, Ltd.

(57) ABSTRACT

A glove and method of making it. The glove has a thumb portion and four finger-receiving portions and is knitted of fibers, e.g., cotton, polycotton, Kevlar®, rendering it flexible, but susceptible to wear. The palmar side of the glove includes plural patches of a wear-resistant flexible material, e.g., polyvinyl chloride, applied, e.g., silk-screened, metal screened, etc., thereto in a flowable state that it intimately bonds to the fibers. The patches on the palmar side of the glove are arranged in a pattern defining plural palmar flexure lines between immediately adjacent patches. The plural palmar flexure lines are arranged to be located over and substantially aligned with the respective crease lines of the hand of the person wearing the glove, such that the person may readily flex his/her hand without the patches interfering with that action.

24 Claims, 2 Drawing Sheets

FABRIC GLOVE WITH WEAR RESISTANT PADS SEPARATED BY FLEXIBILITY ZONES AND METHOD OF MAKING THE SAME

BACKGROUND OF THE INVENTION

This invention relates generally to gloves, and more particularly to knitted gloves having plural zones or patches of a wear resistant flexible material affixed thereto to provide good resistance to wear, while not interfering with the free flexing of the fingers and hand of the wearer.

Various types of seamless knitted gloves formed of conventional materials, such as cotton, poly-cotton, or KEVLAR®, are commercially available for use by workers, either as a primary glove or as a liner for an outer glove, to provide some measure of protection from injury and some cushioning for the hand of workers. While such seamless, knitted gloves or liners provide a good, comfortable fit, their open weave or knit construction renders them susceptible to abrasion. Accordingly, it is a common practice to include coatings of a flexible, wear-resistant material, e.g., polyvinyl chloride, applied thereon to provide some measure of wear resistance. Those coatings have either been applied entirely over the glove, or in random block patterns or stripes or small dots. All of the patterns utilized heretofore for wear-protective coatings exhibit one or more drawbacks. For example, a solid coating over the entire glove or over its entire palmar surface buckles when the hand is flexed, causing creasing of the coating and wearer discomfort. So too, stripes extending the entire length of the glove tend to buckle when the glove is flexed. While small dots, blocks or patches may eliminate or reduce the buckling problem, they nevertheless exhibit a tendency to peel off Moreover, such small dots or patches provide a limited wear-resistant surface.

Other materials, such as leather, rubber, vinyl, etc., have been used for work gloves, and some of such gloves have included pads or other portions to increase comfort and/or provide some cushioning or protection.

For example U.S. Pat. No. 4,748,690 (Webster) discloses a leather glove having springy pads or cushions 16, 18, 20, 22, 24, 26, 28, and 30 which are located on the palmar side and spaced from each other along the hand's normal crease lines (See FIGS. 4 and 5). These pads are provided to provide cushioning to the wearer of the glove.

U.S. Pat. No. 4,663,784 (Ash) discloses a knitted or woven elastic material hand glove. The glove also includes two palm pieces comprised of generally non-elastic material, e.g., leather or vinyl laminated onto a backing material. The palm pieces are sewn along their peripheries to the elastic material of the glove. The palm pieces are fashioned such that one piece, generally triangular, is attached to form closely spaced, side-by-side stretch lines with the first palm part so that the glove material can stretch and deform in a palm area independently of the palm parts.

U.S. Pat. No. 5,581,809 (Mah) discloses a protective glove which also has pads on the palmar side which are separated from one another along the hand's normal crease lines (See FIG. 2).

Other United States patents relating to gloves having patches or pads on them are as follows: U.S. Pat. No. 3,597,765 (Stanton), U.S. Pat. No. 4,042,975 (Elliott Jr. et al.), U.S. Pat. No. 4,691,387 (Lopez), and U.S. Pat. No. 5,218,719 (Johnson).

While the prior art gloves may be generally suitable for their intended purpose they still leave much to be desired from the standpoint of resistance to wear, comfort, etc. A need thus exists for flexible, wear resistant knitted glove.

OBJECTS OF THE INVENTION

Accordingly, it is a general object of this invention to provide a knitted work glove which overcomes the disadvantages of the prior art and which addresses that need.

It is a further object of this invention to provide a knitted work glove which includes plural wear resistant material areas on the palmar side of the glove.

It is a further object of this invention to provide a knitted work glove which includes plural wear resistant material areas on the palmar side of the glove in a predefined pattern with spaces between adjacent areas forming fold lines for enabling the glove to readily fold thereat.

It is still a further object of this invention to provide a knitted work glove which includes plural wear-resistant areas disposed in a pattern establishing plural fold lines corresponding to the fold lines of the hand of the wearer.

It is yet a further object of this invention to provide a method of making a knitted work glove to includes wear resistant areas disposed on the palmar side of the glove in a pattern establishing plural fold lines corresponding to the fold lines of the hand of the wearer.

SUMMARY OF THE INVENTION

A glove and method of making it. The glove is arranged to be worn on the hand of a person and has a thumb portion and at least one finger-receiving portion. The glove is knitted of fibers rendering it flexible, but susceptible to wear. The glove has a palmar side which includes plural, e.g., four, patches of a wear-resistant flexible material, e.g., polyvinyl chloride, applied, e.g., silk-screened, metal screened, etc., to the palmar side of the glove. The wear-resistant flexible material is applied to the fibers of the glove in a flowable state, whereupon some of the flowable material intimately engages the fibers and some of the material gains ingress to the interstices between the fibers to be intimately bonded thereto.

The patches are arranged in a pattern defining plural palmar flexure lines between immediately adjacent patches. The palmar flexure lines are substantially oriented and aligned with respective crease lines of the palm of the hand of the person wearing the glove, such that the person may readily flex his/her hand without the patches interfering with such action.

In accordance with one preferred embodiment of the glove it includes one thumb receiving portion and four finger receiving portions. The plural patches on the palmar side of said glove form at least three palmar flexure lines between immediately adjacent patches which are oriented generally aligned with respective crease lines of the palm of the person. Each of the finger receiving portions also includes plural patches bonded thereto on the palmar side of the glove but spaced from one another to form plural finger flexure lines between immediately adjacent patches, with those finger flexure lines being oriented generally aligned with respective crease lines ofthe fingers of the person. The thumb receiving portion also includes plural patches bonded thereto on said palmar side of the glove but spaced from each other to form plural thumb flexure lines between immediately adjacent patches, with those thumb flexure lines being oriented generally aligned with respective crease lines of the thumb of the person.

DETAILED DESCRIPTION OF THE PREFERRED EMBODIMENT

Figure 1:
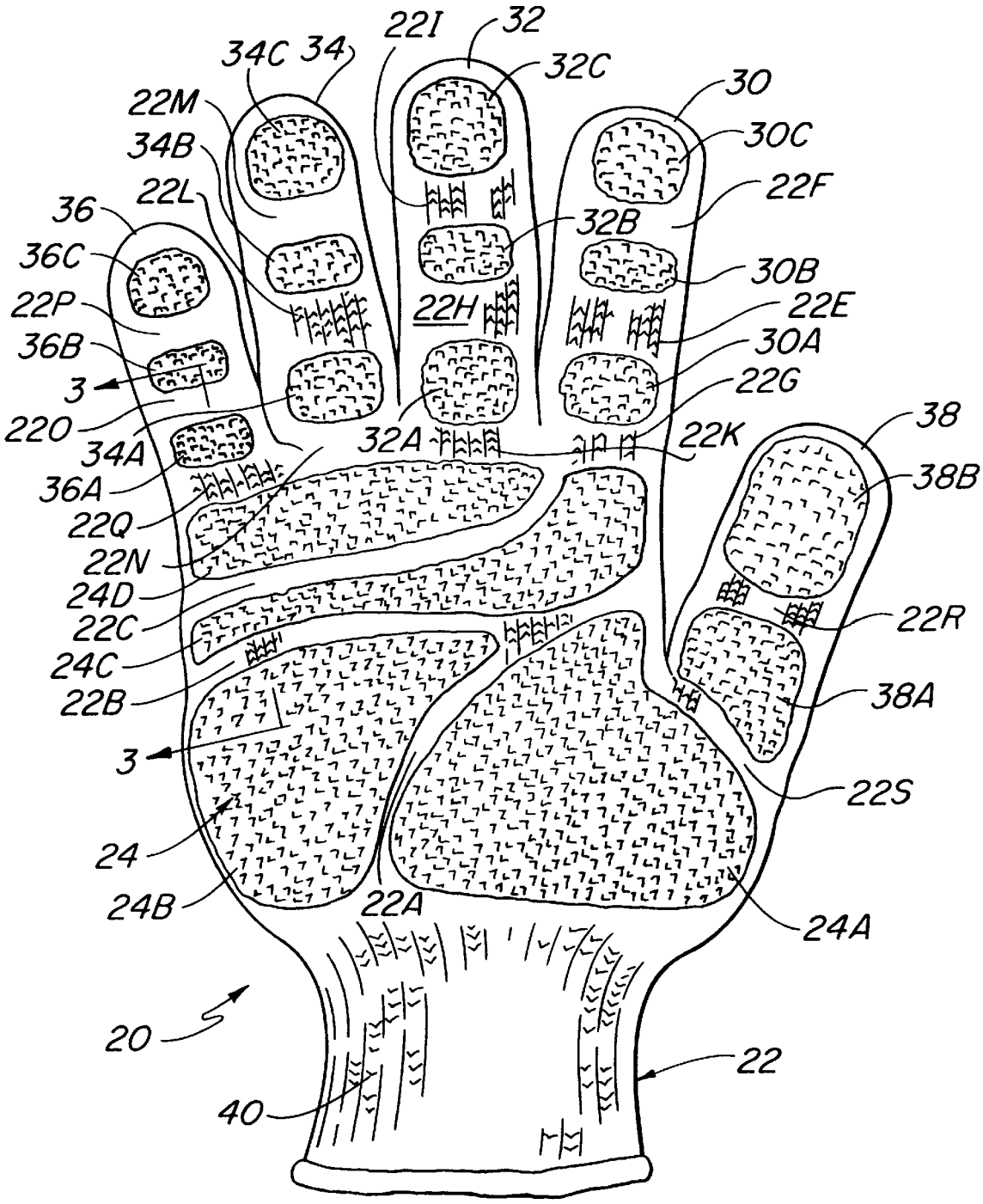
FIG. 1 is a plan view of the palmar side of a glove constructed in accordance with this invention.
Figure 2:
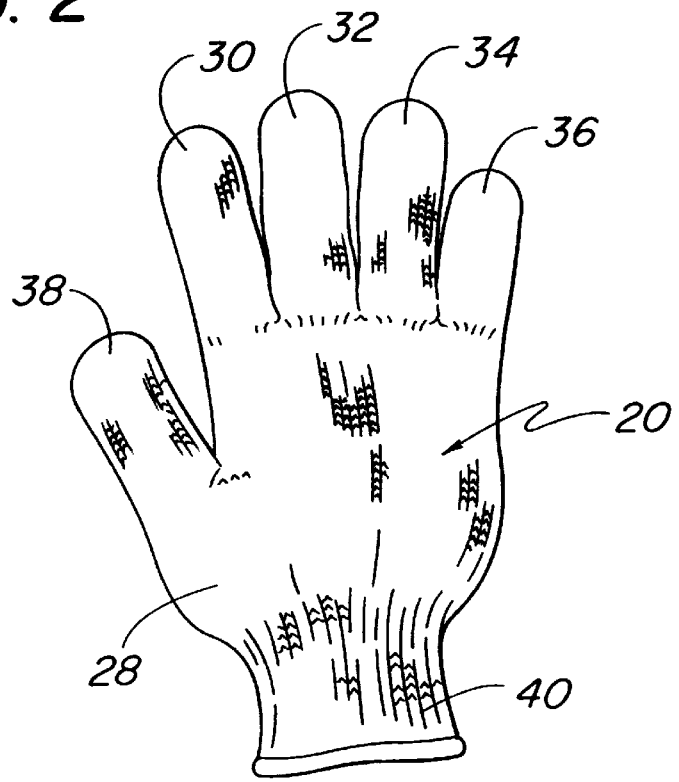
FIG. 2 is a reduced plan view of the dorsal side of the glove shown in FIG. 1.
Figure 3:
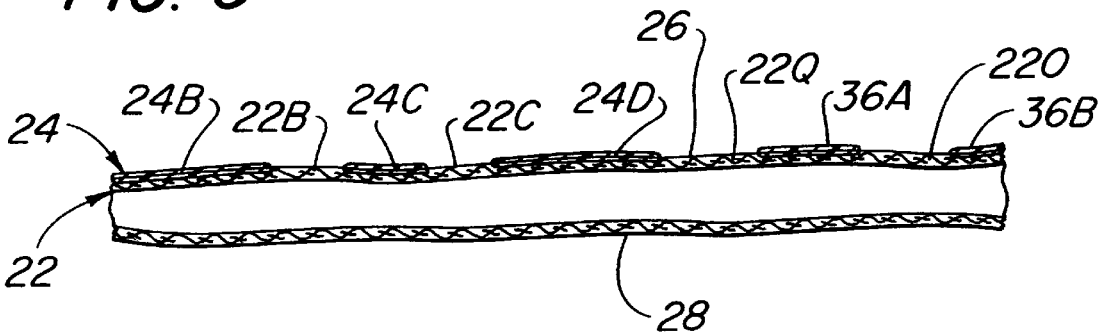
FIG. 3 is an enlarged sectional view taken along line 3—3 of FIG. 1.

Referring now to the various figures of the drawing wherein like reference characters refer to like parts, there is shown at 20 in FIGS. 1 and 2 a seamless knitted glove constructed in accordance with this invention.

The glove 20 includes a shell 22 and a group 24 of plural wear-resistant patches (to be described later). Before describing those patches, a brief description of the glove's shell 22 is in order. To that end as can be seen the glove's shell 22 is a knitted or woven body of a conventional shape. Thus, it includes a palmar side or face 26, a dorsal side or face 28, a plurality, e.g., four, finger pockets 30, 32, 34, and 36, a thumb pocket 38, and a gathered or expandible wrist band 40. When the shell 22 is worn on the wearer's hand, each of the finger pockets receives a respective finger of the wearer, while the thumb pocket receives the wearer's thumb, with the palmar side 26 of the shell overlying the wearer's palm, the dorsal side overlying the back of the wearer's hand, and with the wearer's wrist extending through the wrist band 40.

It should be pointed out at this juncture that the shell may take the form of a "mitten" or be "fingerless." With respect to the former, i.e., when the shell 22 takes the form of a mitten, the finger pockets 30–36 will comprise a single pocket (not shown) into which all the fingers of a person's hand are placed during wearing, while the wearer's thumb extends into the thumb pocket 38. When the shell is of the fingerless type there will be no finger pockets or thumb pocket, or else the finger pockets and/or thumb pocket may be of a short, truncated length, each of which is open at the end to enable the distal end of respective ones of the wearer's digits to extend thereout.

The shell 22 can be made from any suitable material having an elastic nature. Preferably the material is woven or knitted using cotton, or poly cotton or Kevlar® fibers or threads, but other materials such as, acrylic, Ragg wool, or spandex fibers/threads can be used as well.

As mentioned earlier the palmar side of the knitted glove includes a group of plural wear resistant, flexible patches 24. In accordance with a preferred embodiment of this invention the patches of wear-resistant, flexible material are preferably polyvinyl chloride. Other flexible, wear-resistant materials can be used for the patches 24, if desired. Moreover, the patches can be applied to the glove in various ways, so long as they make intimate engagement with the fibers of the shell 22 to be fixedly bonded or secured thereto, resistant to coming off. It is preferred, although not mandated, that the wear-resistant flexible material forming the patches 24 is applied to knitted or woven shell 22 in a flowable state, e.g., silk-screened, metal screened, etc., to the shell, whereupon some of the flowable material intimately engages the shell's fibers and some of the material gains ingress to the interstices between those fibers to be intimately bonded to the shell.

In the exemplary embodiment of the glove 20 shown herein there are four patches 24A, 24B, 24C and 24D in the palm region of the palmar side 26 of the shell 22, there are three patches 30A, 30B, and 30C on palmar side of the finger pocket 30, there are three patches 32A, 32B, and 32C on the palmar side ofthe finger pocket 32, there are three patches 34A, 34B, and 34C on the palmar side of the finger pocket 34, there are three patches 36A, 36B, and 36C on the palmar side of the finger pocket 36, and there are two patches 38A and 38B on the palmar side of the thumb pocket 38.

In accordance with one preferred embodiment of this invention each of the patches is shaped, sized, and oriented to conform generally to the shape of the portion of the hand of the wearer over which it will be disposed when the glove is worn. Thus, the patches 24A, 24B, 24C and 24D in the palm region of the palmar side 26 of the shell 22 are each irregularly shaped members which conform generally to the shape of respective portions of the palm of the wearer's hand. Moreover, the patches 24A–24D are located, oriented and spaced from one another form respective fold or crease lines 22A, 22B, and 22C therebetween. In particular, the fold line 22A is located between the patches 24A and 24B and is generally coincident with the generally diagonally extending, somewhat arcuate crease line of the wearer's palm. The fold line 22B is located between the patches 24B and 24C and is generally coincident with the lower of the generally transversely extending crease lines of the wearer's palm. The fold line 22C is located between the patches 24C and 24D and is generally coincident with the upper of the generally transversely extending crease lines of the wearer's palm.

The patches 30A, 30B, and 30C on palmar side of the finger pocket 30 are each somewhat regularly shaped members, e.g., rounded cornered rectangles, which conform generally to the shape of respective portions of the index finger. Moreover, the patches 30A–30C are located, oriented and spaced from one another form respective fold or crease lines 22E and 22F therebetween. In particular, the fold line 22E is located between the patches 30A and 30B and is generally coincident with the generally transverse extending index finger crease line closest to the wearer's palm. The fold line 22F is located between the patches 30B and 30C and is generally coincident with the generally transverse extending index finger crease line further from the wearer's palm. There is also a fold line 22G between the patch 30A and the patch 24C. This fold line is generally coincident with the crease line of the index finger and the palm.

The patches 32A, 32B, and 32C on palmar side of the finger pocket 32 are each somewhat regularly shaped members, e.g., rounded cornered rectangles, which conform generally to the shape of respective portions of the middle finger. Moreover, the patches 32A–32C are located, oriented and spaced from one another form respective fold or crease lines 22H and 221 therebetween. In particular, the fold line 22H is located between the patches 32A and 32B and is generally coincident with the generally transverse extending middle finger crease line closest to the wearer's palm. The fold line 221 is located between the patches 32B and 32C and is generally coincident with the generally transverse extending middle finger crease line further from the wearer's palm. There is also a fold line 22K between the patch 32A and the patch 24D. This fold line is generally coincident with the crease line of the middle finger and the palm.

The patches 34A, 34B, and 34C on palmar side of the finger pocket 34 are each somewhat regularly shaped members, e.g., rounded cornered rectangles, which conform generally to the shape of respective portions of the ring finger. Moreover, the patches 34A–34C are located, oriented and spaced from one another form respective fold or crease lines 22L and 22M therebetween. In particular, the fold line 22L is located between the patches 34A and 34B and is generally coincident with the generally transverse extending ring finger crease line closest to the wearer's palm. The fold line 22M is located between the patches 34B and 34C and is generally coincident with the generally transverse extending ring finger crease line further from the wearer's palm. There is also a fold line 22N between the patch 34A and the patch 24D. This fold line is generally coincident with the crease line of the ring finger and the palm.

The patches 36A, 36B, and 36C on palmar side of the finger pocket 36 are each somewhat regularly shaped members, e.g., rounded cornered rectangles, which conform generally to the shape of respective portions of the small finger. Moreover, the patches 36A–36C are located, oriented and spaced from one another form respective fold or crease lines 220 and 22P therebetween. In particular, the fold line 220 is located between the patches 36A and 36B and is generally coincident with the generally transverse extending small finger crease line closest to the wearer's palm. The fold line 22P is located between the patches 36B and 36C and is generally coincident with the generally transverse extending small finger crease line further from the wearer's palm. There is also a fold line 22Q between the patch 36A and the patch 24D. This fold line is generally coincident with the crease line of the small finger and the palm.

The patch 38A on palmar side of the thumb pocket 38 is a somewhat irregularly shaped member, which conforms generally to the shape of the portion of the wearer's thumb closest to the palm, while the patch 38B on palmar side of the thumb pocket 38 is a somewhat regularly shaped member, e.g., a rounded cornered rectangle, which conforms generally to the shape of the portions of the wearer's thumb furthest from the palm. Moreover, the patches 38A and 38B are located, oriented and spaced from one another to form a fold or crease line 22R therebetween. In particular, the fold line 22R is located between the patches 38A and 38B and is generally coincident with the generally transverse extending crease line of the thumb. There is also a fold or crease line 22S between the patch 38A and the patch 24A. This fold line is generally coincident with the crease line of the thumb and the palm.

By providing the fold lines generally coincident with the naturally occurring crease lines of the wearer's palm and fingers, the will be no interference with the folding of the glove's shell along those lines by the patches 24. Moreover, by configuring, sizing and orienting the patches to correspond to the underlying portions of the wearer's hand, when the wearer closes his/her hand the various patches tend to come together to effectively form an uninterrupted or solid wear surface.

It should be pointed out at this juncture that the embodiment of the glove as described above is merely exemplary. Thus, the glove may be formed by other than knitting, e.g., it may be woven, or may be formed of non-woven (disorganized) fibers. Moreover, the shell need not be seamless. Further still the glove may include less than the number of patches shown and described. Moreover, those patches need not be shaped as shown. Further still the patches can be of any desired thickness for protection of the wearer's hand and resistance to erosion. If the patches are somewhat thin such that they can flex with some ease so that they produce minimal interference with the flexure of the glove, the number and spacing of the fold lines can be minimized. If, however, the patches are relatively thick or formed of a stiffer material so that they cannot fold or crease without wearer discomfort, then the glove should make use of more fold lines. What is important is that there be at least a minimum number of patches and fold lines between the patches in the palm area, and if desired, in the fingers, to enable the wearer of the glove to close his/her hand without interference from the material making up the patches.

As should now be appreciated by those skilled in the art from the foregoing the glove of this invention is highly advantageous in that it not only affords a good hand grip when needed in the course of work or sports, but also retains the full dexterity and freedom of action of the wearer's hand, virtually as if no glove were worn, or that the glove did not include any protective pads. This is due to the fact that the protective pads or patches which are disposed on the palmar side of the glove are spaced from one another along plural palmar flexure lines which are oriented generally aligned with the crease lines of the palm and fingers of the wearer. Accordingly, the wearer can readily flex his/her hand without the patches interfering with such action.

Without further elaboration the foregoing will so fully illustrate my invention that others may, by applying current or future knowledge, adopt the same for use under various conditions of service.

I claim:

1. A glove arranged to be worn on the hand of a person, the person's hand having a palm and fingers, each with plural crease lines, said glove comprising a thumb receiving portion and at least one finger-receiving portion and being formed of fibers rendering it flexible, but susceptible to wear, said glove having a palmar side including plural patches of a wear-resistant flexible material, said flexible material being applied to said glove in a flowable state, whereupon some of said flexible material intimately engages said fibers and some of said flexible material gains ingress into interstices between said fibers to be intimately bonded to said fibers and resistant to separation therefrom, said patches and portions of the fibers to which they are bonded forming respective areas of reduced flexibility and increased wear-resistance, said patches being arranged in a pattern defining plural palmar flexure lines between immediately adjacent patches, at least one of said plural palmar flexure lines being oriented generally aligned with at least one of the crease lines of the palm of the person, such that the person may readily flex his/her hand without said patches interfering with such action.

2. The glove of claim 1 wherein said patches are formed of polyvinyl chloride.

3. The glove of claim 1 wherein said patches are silk-screened onto said fibers.

4. The glove of claim 1 wherein said patches are metal-screened onto said knitted fibers.

5. The glove of claim 1 wherein said glove includes four finger receiving portions.

6. The glove of claim 5 wherein each of said finger receiving portions includes plural patches bonded thereto on said palmar side of said glove but spaced from one another to form plural finger flexure lines between immediately adjacent patches, said plural finger flexure lines being oriented generally aligned with respective crease lines of the fingers of the person.

7. The glove of claim 6 wherein said thumb receiving portion includes plural patches bonded thereto on said palmar side of said glove but spaced from each other to form plural thumb flexure lines between immediately adjacent patches, said plural thumb flexure lines being oriented generally aligned with respective crease lines of the thumb of the person.

8. The glove of claim 7 wherein said patches on said palmar side of said glove form at least three palmar flexure lines between immediately adjacent patches, said at least three palmar flexure lines being oriented generally aligned with respective crease lines of the palm of the person.

9. The glove of claim 1 wherein said fibers are formed of KEVLAR®.

10. The glove of claim 1 wherein said fibers are formed of poly-cotton.

11. The glove of claim 1 wherein said fibers are formed of cotton.

12. The glove of claim 1 wherein said glove is knitted of said fibers.

13. The glove of claim 12 wherein said glove is seamless.

14. A method of making a glove arranged to be worn on the hand of a person, the hand of the person having a palm and fingers, each including plural crease lines, said method comprising the steps of:

(a) providing a glove having a thumb receiving portion and at least one finger-receiving portion, said glove being formed of fibers rendering it flexible, but susceptible to wear, said glove having a palmar side;

(b) applying plural patches of a wear-resistant flexible material to said palmar side of said glove in a flowable state to intimately engage said fibers and to enter into the interstices between said fibers to be intimately bonded thereto, said patches being arranged in a pattern defining plural palmar flexure lines between immediately adjacent patches, said plural palmar flexure lines being arranged to be located generally aligned with respective crease lines crease lines of the palm of the person when said glove is worn; and (c) allowing said flowable material to harden and to be permanently affixed to the fibers of said glove to protect said knitted glove from wear at said patches, while enabling the person wearing the glove to readily flex his/her hand without said patches interfering with such action.

15. The method of claim 14 wherein said patches are formed of polyvinyl chloride.

16. The method of claim 14 wherein said patches are silk-screened onto said fibers.

17. The method of claim 14 wherein said patches are metal-screened onto said fibers.

18. The method of claim 14 wherein said fibers are knitting to forms said glove.

19. The method of claim 14 comprising bonding plural patches of said flexible material to each of said finger receiving portions on said palmar side of said glove but spaced from one another to form plural finger flexure lines between immediately adjacent patches, said plural finger flexure lines being oriented generally aligned with respective crease lines of the fingers of the person.

20. The method of claim 19 comprising bonding plural patches of said flexible material to said thumb receiving portion to form plural thumb flexure lines between immediately adjacent patches, said plural thumb flexure lines being oriented generally aligned with respective crease lines of the thumb of the person.

21. The method of claim 19 comprising bonding plural patches of said flexible material on said palmar side of said glove form at least three palmar flexure lines between immediately adjacent patches, said at least three palmar flexure lines being oriented generally aligned with respective crease lines of the palm of the person.

22. The method of claim 14 wherein said fibers are formed of KEVLAR®.

23. The method of claim 14 wherein said fibers are formed of poly-cotton.

24. The method of claim 14 wherien said fibers are formed of cotton.

* * * * *